US005297402A

United States Patent [19]

Bergmann

[11] Patent Number: 5,297,402

[45] **Date of Patent: * Mar. 29, 1994**

[54] WARP KNITTED FABRIC AND PROCESS AND MACHINE THEREFOR

[75] Inventor: Gerhard Bergmann, Heusenstamm, Fed. Rep. of Germany

[73] Assignee: Karl Mayer Textilmachinenfabrik GmbH, Obertshausen, Fed. Rep. of Germany

[ * ] Notice: The portion of the term of this patent subsequent to Feb. 8, 2011 has been disclaimed.

[21] Appl. No.: 9,771

[22] Filed: Jan. 27, 1993

[30] Foreign Application Priority Data

Feb. 3, 1992 [DE] Fed. Rep. of Germany ..... 4202981

[51] Int. Cl.[5] ..... D04B 23/16; D04B 21/14

[52] U.S. Cl. ..... 66/203; 66/195

[58] Field of Search ..... 66/192, 195, 196, 204, 66/207, 214, 203

[56] References Cited

U.S. PATENT DOCUMENTS 3,340,134 9/1967 Porter et al. ..... 66/195
5,150,587 9/1992 Bergmann ..... 66/195
5,172,570 12/1992 Wade et al. ..... 66/192 X

FOREIGN PATENT DOCUMENTS 1785138 2/1972 Fed. Rep. of Germany .
4025132 2/1992 Fed. Rep. of Germany .
1182283 6/1959 France ..... 66/195

*Primary Examiner*—Andrew M. Falik
*Assistant Examiner*—John Calvert
*Attorney, Agent, or Firm*—Omri M. Behr; Matthew J. McDonald

[57] ABSTRACT

A process for the production of warp knitted fabric uses a ground guide bar (L1) and at least two guide bars (L2 and L3) with partial threading. Threads (14) of a first additional thread system are worked with a main lap, which comprises a two row repeat. Threads (15) of a second additional thread system alternate between this main lapping and a pattern lap. Thread consumption in in the pattern lap are kept the same as in the main lap by using displacements that are larger and smaller than that in the main lap. A warp knitting machine (1) for providing such a process comprises appropriate control arrangements ( 6, 7, 8) for the displacement of the ground guide bar (L1) and the additional guide bars (L 2, L3). Furthermore, a novel warp knitted fabric is produced thereby. It is thus possible, by simple means, to produce a warp knitted fabric which is differently structured both in the warp direction, as well as in the weft direction.

23 Claims, 1 Drawing Sheet

WARP KNITTED FABRIC AND PROCESS AND MACHINE THEREFOR

BACKGROUND OF THE INVENTION

The invention is concerned with warp knitted fabrics and a machine and process for preparing such warp knitted fabrics. Conceptually, the process is performed with a ground thread system laid by a ground guide bar as the ground fabric. At least two additional thread systems, which are taken from a common warp beam, are each processed by a supplemental guide bar with partial threading. Conceptually related to this process is a warp knitting machine having a ground guide bar and at least two additional guide bars served from a common warp beam with partial threading. The machine also has a ground and at least two additional control arrangements for displacing guide bars. The invention also relates to a fabric produced in accordance with such a process.

In known processes (German OS 1785 138) two additional guide bars perform, in each stitch row, underlaps of different size next to each other. These laps, under tensioned conditions, are altered every two rows or more, so that within each pattern repeat they average out, so that each of the additional guide bars performs the same number of different laps. In the example (of the reference) a partial threading and four row repeat is foreseen for each additional guide bar with one full and one empty, in which two tricot laps and two satin laps alternate with each other in every stitch row to a satin lap. This gives an upper surface structure which is differentiable from smooth fabric. Structuring is, however, not strongly emphasized since the long underlaps are crossed with the underlaps of the tricot and are thereby held down. If one wishes to produce patterned fabric one can only obtain a stripe type pattern.

A purpose of the present invention is to obtain a patterned warp knitting which has a differentiated structure both in the weft direction and in the warp direction.

SUMMARY OF THE INVENTION

In accordance with the illustrative embodiments demonstrating features and advantages of the present invention, there is provided a process for the production of warp knitted fabric. The process employs (a) a plurality of spaced needles, (b) a ground thread system having a ground guide bar with a plurality of guides, and (c) first and second additional thread systems having a common warp beam and each having a supplemental guide bar with a plurality of guides. The method includes the step of partially threading from the common warp beam the supplemental guide bar of each of the first and the second additional thread systems. Another step is executing a main lap with a two row repeat with the first additional thread system. The process also includes the step of performing with the second additional thread system, in alternation, main lapping and pattern lapping. The pattern lapping is performed with displacements larger and smaller than that of the main lap to keep the average thread utilization substantially equivalent to that of the main lapping. Another step of the process is laying a ground fabric with the ground guide bar acting as part of the ground thread system.

A related warp knitting machine of the same invention is adapted to consume thread from at least a common warp beam. The machine has a plurality of needles, a ground guide bar, and a ground control arrangement for displacing the ground guide bar. Also included is at least a first and second additional guide bar partially threaded from the common warp beam. The machine also has at least two additional control arrangements for displacing the two additional guide bars. A first one of the additional control arrangements can displace the first additional guide bar to provide a main lap containing a two row repeat. A second one of the additional control arrangements can displace the second additional guide bar to provide the main lap alternating with a pattern lap. The pattern lap displacements have the relation described for the above process.

A related warp knitted fabric in accordance with the same invention has sequential areas alternating in the weft direction. This fabric includes a ground fabric having a ground thread system with threads in tricot laps. A first additional thread system in the fabric is laid in the warp direction totally in cloth lap. The fabric also has a second additional thread system which alternates in the warp direction between cloth lap and a patterning lap. This patterning lap contains velvet lapping and another lapping with smaller displacement than the velvet lapping. This patterning lap can keep thread consumption substantially the same as that in the cloth lap.

Such fabrics and such processes and machines can achieve a patterned warp knitting which has a differentiated structure both in the weft direction and in the warp direction. This structure is achieved with a first additional thread system laying a main lap with a two row repeat, and a second additional thread system laying main laps alternating with pattern laps. The pattern laps use displacements larger and smaller than the main lap to keep average thread consumption uniform with the main lap.

This procedure makes a very strongly structured pattern area where the second additional system in cooperation with other systems works a pattern lap. The second thread system working with the main lapping system, can make a basis area with a less structured upper surface, wherein the basis and pattern areas can follow each other in the warp direction. The first additional thread system constantly works to form the main lap. This provides a further basis area which, together with the pattern areas, gives rise to a differentially structured surface area as well. In all of this, care is taken that the thread consumption of additional guide bars is substantially equal so that the additional thread system can be fed by a warp beam.

If in the partial threading, the second additional thread system comprises groups of at least three neighboring threads, an emphasized surface pattern is obtained.

In utilizing the thread arrangement, the threads of the second additional thread system, during the switch from the underlap into the overlap positions, are always the last to move through the needle gaps even where there is thread crossing. This trailing avoids covering of the long underlaps.

Where the displacement covers at least five needle spaces, there is thus obtained strong, elastic, relief type surface in the pattern area.

It is particularly advantageous when the main lap is a cloth or "tuch" lap. When, in the patterning area a larger displacement is used, it must correspond to a smaller displacement, to readily obtain desired length of underlap.

It is particularly appropriate to use velvet and pillar stitches to give rise to long underlaps.

In the further development, the ground system is worked as a tricot lap, the simplest ground lap. By combining a cloth lap as a main lap, there is obtained a charmeuse warp knitted fabric which is patterned on the cloth side.

It is further desirable that the ground thread system utilizes elastic threads. Such a fabric pulls itself together very much. For example, there is a compression in the warp and weft direction of about 50%. Thus, the free lying underlaps are thrown into even greater contrast. This gives rise to a very strong elastically operating upper surface.

With respect to construction of the equipment, advantages are achieved by a machine with an additional control arrangement (7) so arranged that the first additional guide bar (L2) which contains the two row repeat (R12), provides the main lap and the second additional control arrangement (8) is so arranged that the second additional guide bar (L3) alternately creates this main lap and a pattern lap. By using greater and smaller displacements than the main lap, the thread utilization substantially equal that in the main lap.

It is sufficient to utilize a warp knitting machine with very simple construction which can provide clearly defined patterning without a jacquard arrangement. The simplest case has a lapping system with a ground guide bar and two additional guide bars, one of which requires a control arrangement having merely only a two row repeat.

The second additional control arrangement (8) during predetermined work cycles displaces the second additional guide bar (L3) over at least five needle spaces. Such displacement leads to the desired long underlaps, which are necessary for elastic patterning.

The second displacement guide bar (L3) during the underlap position is the furthest away from the needles (3). This positioning permits the long underlaps to lie free.

The novel goods comprises a ground fabric having a ground thread system with threads (12) in tricot laps, sequential areas (B1; M, B2) in the weft direction. In these sequential areas, a first additional thread system operates in the warp direction totally in cloth lap and a second additional thread system alternates in the warp direction in cloth lap and in a patterning lap. The patterning contains velvet lapping and other lapping with a smaller displacement than velvet lapping so that the thread consumption is substantially the same as that in the cloth lap. The preferred fabric type enables a strongly structured patterning area to be provided.

In a further construction for the second additional thread system, three threads (15) are provided close to each other to support this strong structuring, since the long underlaps lie free.

The embodiment wherein the underlap of the threads of the second additional thread system lie on the upper side of the fabric gives a particularly elastic structure.

The elasticity of the threads in the ground thread system leads further to the enhancement of the relief effect.

BRIEF DESCRIPTION OF THE DRAWINGS

The invention may be more clearly understood by the drawings, wherein.

DETAILED DESCRIPTION OF THE PREFERRED EMBODIMENTS

Figure 1:
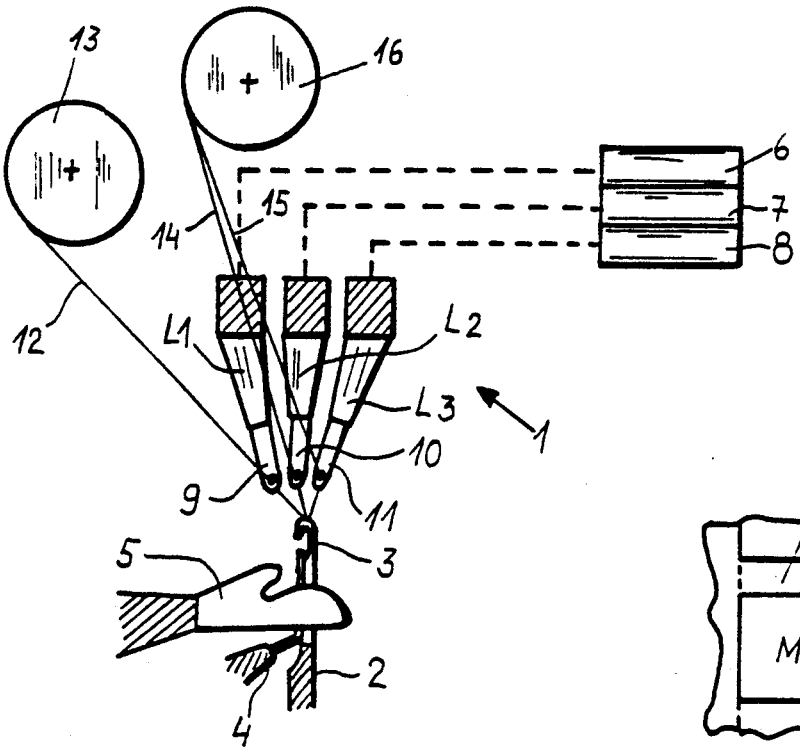
FIG. 1 a schematic representation of a warp knitting machine in accordance with principles of the present invention.

A warp knitting machine 3 is provided with a needle bar 2 supporting needles 3 which operate in conjunction with sliders 4, as well as, knockover closing sinkers 5 or a knockover bar in conjunction with stitch comb sinkers. There are three guide bars namely, the ground guide bar L1, a first additional guide bar L2 and a second additional guide bar L3. The guide bars are displaced in the usual manner by control arrangements namely, a ground control arrangement 6 and two additional control arrangements 7 and 8, in their longitudinal direction, in accordance with a predetermined pattern repeat. Control arrangements 6, 7 and 8 may use cam plates, pattern chains or the like. The guide bars L1, L2 and L3 carry guides 9, 10 and 11, respectively.

The needles 3 on needle bar 2 and can reciprocate longitudinally, with sliders 4 synchronously opening and closing the hook of needles 3. Guide bars L1, L2 and L3 can swing between the needles 3 and on either side of the row of needles and shog to perform an underlap and overlap.

The guides 9 are totally charged with threads of the ground thread system 12, which are taken from a warp beam 13. The guides 10 are charged with threads 14 of a first additional thread system and the guides 11 by threads 15 of a second additional thread system, each from a common warp beam 16. Thus, the threads in both additional guide bars L2 and L3 are provided in a mutually complementary, partial threading. Additional guide bar L3 has groups of at least three guides 11. In the example illustrated in FIG. 2 there are five such guides which are fully charged, while the remaining guides are empty. In contrast thereto, in the additional guide bar L2, those guides 10 that are complementary to the empty guides 11 are fully charged, but the rest remain empty.

Figure 2:
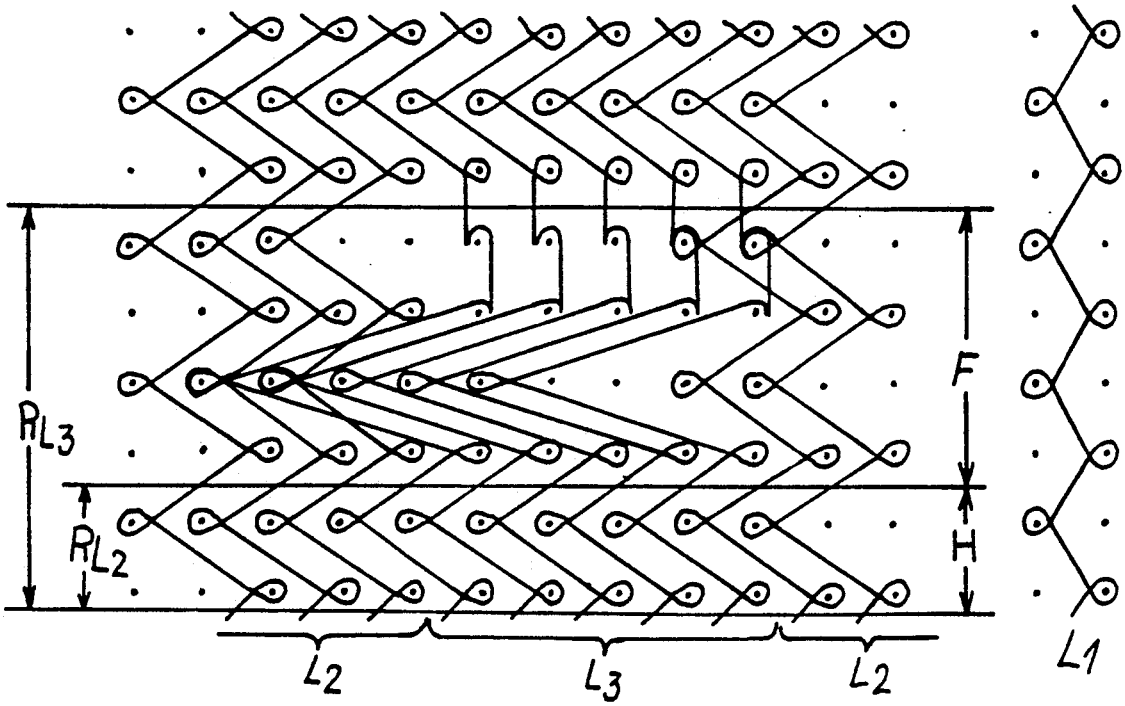
FIG. 2 is the lapping diagram for a process and a warp knitted fabric produced in accordance with the present invention.

FIG. 2 shows the ground guide bar L1 displaced by control arrangement 6 in the manner of a tricot lap.

The control arrangement 7 displaces the first additional guide bar L2 to provide a main lap shown herein as two row repeat RL2. The main lap is thus constantly repeated. In the illustrated example this main lap is shown as a cloth lap.

The second additional guide bar L3 is displaced by control arrangement 8 to provide alternately the main lap H, (herein a cloth lap) and a pattern lap F. Pattern lap F is shown as a six row repeat RL3. In the patterning lap F, laps requiring a larger displacement alternate with those having a smaller displacement than main lap H. In the illustrated example for pattern lap F, velvet laps requiring a displacement of over five needle spaces, alternate with a pillar stitch, which require a displacement of merely one needle space. The larger displacement leads to a large underlap. These underlaps lie on the upper surface of the goods of the fabric, because the second additional guide bar L3 is furthest removed from the needles 3 in the underlap position. Thus, threads 15 of the second additional thread system are the last to move through the needle gaps.

Figure 3:
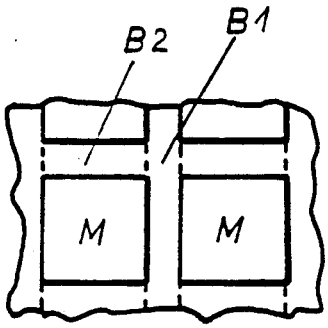
FIG. 3 is a plan view of the fabric produced by the present invention.

In total therefore, the region of the pattern lapping forms a pattern area M (FIG. 3) exhibiting a strong relief type of profiling on the upper surface. This feature is emphasized even more, by the utilization of elastic threads in the ground thread system. The continual cloth lapping of the first additional thread system leads to a smooth basis area B1 extending unbroken in the warp direction, and extending between the pattern forming areas M in the weft direction. The second additional thread system forms basis area B2 extending in the warp direction between neighboring pattern areas M. The displacement in the basis area B2 is in the manner of the main lapping (that is, cloth laps) to produce a smooth upper surface. Thus, the patterned area M is surrounded by flat material which leads to a very effective mode of patterning.

Many variations may be obtained from the foregoing examples without departing from the principles of the present invention. For example, two velvet and two pillar stitch lappings may be used in the pattern laps, which may be repeated once or several times before being followed by a cloth lap. The above mentioned lappings can also follow one another sequentially. The lengths of areas M and B2 in the warp direction can be adjusted to have one or many repeats and the ratio of repeats in the two areas can be changed as desired. Furthermore, the pattern laps of the second thread system can also alternate between tricot and satin. It is also possible in a larger repeat to alternate between velvet, satin, tricot and pillar stitch. The basic object, however, is that the same thread consumption should occur as in the first additional thread system.

What is claimed is:

1. A process for the production of warp knitted fabric with (a) a plurality of spaced needles, (b) a ground thread system having a ground guide bar with a plurality of guides, and (c) first and second additional thread systems having a common warp beam and each having a supplemental guide bar with a plurality of guides, comprising the steps of:

partially threading from said common warp beam the supplemental guide bar of each of said first and said second additional thread systems;

executing a main lap with a two row repeat with said first additional thread system;

performing with said second additional thread system, in alternation, main lapping and pattern lapping, said pattern lapping being performed by employing displacements larger and smaller than that of the main lap to keep the average thread utilization substantially equivalent to that of the main lapping; and laying a ground fabric with said ground guide bar acting as part of said ground thread system.

2. A process in accordance with claim 1 wherein the step of partially threading the supplemental guide bar of the second additional thread system includes the step of:

threading in discrete groups of at least three adjacent ones of the guides.

3. A process in accordance with claim 1 wherein lapping is performed with threads in the guides of the second additional thread system being the last to move between the needles, when changing from an underlap into an overlap position.

4. A process in accordance with claim 2 wherein lapping is performed with threads in the guides of the second additional thread system being the last to move between the needles, when changing from an underlap into an overlap position.

5. A process in accordance with claim 1 wherein the work cycle of the pattern lap requires a displacement exceeding at least five needle spaces.

6. A process in accordance with claim 4 wherein the work cycle of the pattern lap requires a displacement exceeding at least five needle spaces.

7. A process in accordance with claim 1 wherein the main lapping is carried out as a cloth lapping.

8. A process in accordance with claim 6 wherein the main lapping is carried out as a cloth lapping.

9. A process in accordance with claim 8 wherein the pattern lapping comprises velvet and pillar stitches.

10. A process in accordance with claim 8 wherein the lapping of the ground thread system is a tricot lap.

11. A process in accordance with claim 10 wherein the ground thread system utilizes elastic threads.

12. A warp knitting machine adapted to consume thread from at least a common warp beam, comprising:

a plurality of needles;

a ground guide bar;

a ground control arrangement for displacing said ground guide bar;

at least a first and second additional guide bar partially threaded from said common warp beam; and at least two additional control arrangements for displacing said two additional guide bars, a first one of said additional control arrangements being operable to displace the first additional guide bar to provide a main lap containing a two row repeat, a second one of said additional control arrangements being operable to displace the second additional guide bar to provide said main lap alternating with a pattern lap, said pattern lap displacements being greater and smaller than the main lap to produce an average thread utilization substantially equal to that in the main lap.

13. Warp knitting machine in accordance with claim 12 wherein the second one of the additional control arrangements during predetermined work cycles displaces the second additional guide bar by at least five needle spaces in one direction.

14. Warp knitting machine in accordance with claim 12 wherein the ground guide bar and the first and second additional guide bars move synchronously between an underlap and an overlap position with said second additional guide bar being the furthest away from the needles for the underlap position.

15. Warp knitting machine in accordance with claim 13 wherein the ground guide bar and the first and second additional guide bars move synchronously between an underlap and an overlap position with said second additional guide bar being the furthest away from the needles for the underlap position.

16. Warp knitted fabric produced with sequential areas alternating in the weft direction, comprising:

a ground fabric having a ground thread system with threads in tricot laps;

a first additional thread system laid in the warp direction totally in cloth lap; and a second additional thread system which alternates in the warp direction between cloth lap and a patterning lap, said patterning lap containing velvet lapping and another lapping with smaller displacement than the velvet lapping, said patterning lap arranged to keep thread consumption substantially the same as that in the cloth lap.

17. Warp knitted fabric in accordance with claim 16 wherein three threads of the second additional thread system are provided close to each other.

18. Warp knitted fabric in accordance with claim 16 wherein the fabric has an upper side and wherein underlapping threads of the second additional thread system lie on the upper side of the fabric.

19. Warp knitted fabric in accordance with claim 17 wherein the fabric has an upper side and wherein underlapping threads of the second additional thread system lie on the upper side of the fabric.

20. Warp knitted fabric in accordance with claim 16 wherein threads of the ground fabric are elastic.

21. Warp knitted fabric in accordance with claim 17 wherein threads of the ground fabric are elastic.

22. Warp knitted fabric in accordance with claim 18 wherein threads of the ground fabric are elastic.

23. Warp knitted fabric in accordance with claim 19 wherein threads of the ground fabric are elastic.

* * * * *